US005308305A

United States Patent [19]

Romney

[11] Patent Number: 5,308,305

[45] Date of Patent: May 3, 1994

[54] DEVICE TO AUGMENT EXERCISE

[75] Inventor: Jan W. Romney, 645 E. 5900 South, Salt Lake City, Utah 84107

[73] Assignee: Jan W. Romney, Salt Lake City, Utah

[21] Appl. No.: 671,498

[22] Filed: Mar. 19, 1991

[51] Int. Cl.[5] ..... A63B 21/02

[52] U.S. Cl. ..... 482/124; 482/121; 2/69

[58] Field of Search ..... 272/139, 119, 135, 137, 272/142, 143; 2/69, 79, 125; 128/80 G, 25 R; 482/124, 105, 121, 122, 125, 126, 139

[56] References Cited

U.S. PATENT DOCUMENTS

| | | | |
|---|---|---|---|
| Re. 32,547 | 11/1987 | Reed et al. . | |
| 886,032 | 4/1908 | Barrett . | |
| 1,562,294 | 11/1925 | Cooper | 128/80 G |
| 1,663,641 | 3/1928 | Smallwood . | |
| 2,097,376 | 10/1937 | Marshman | 272/139 |
| 3,502,073 | 3/1970 | Stanley | 128/882 X |
| 4,065,814 | 1/1978 | Fox . | |
| 4,121,827 | 10/1978 | Weider . | |
| 4,343,299 | 8/1982 | Oxendine, Jr. | 128/845 |
| 4,371,161 | 2/1983 | Williams . | |
| 4,441,707 | 4/1984 | Bosch | 272/119 |
| 4,478,414 | 10/1984 | Molloy . | |
| 4,728,103 | 3/1988 | Fulton . | |
| 4,731,882 | 3/1988 | Ekman | 2/69 |
| 4,889,336 | 12/1989 | Schneiderman . | |
| 4,910,802 | 3/1990 | Malloy . | |
| 4,953,856 | 9/1990 | Fox, III . | |
| 4,961,573 | 10/1990 | Wehrell . | |
| 4,968,028 | 11/1990 | Wehrell . | |
| 4,993,705 | 2/1991 | Tölle | 272/142 X |
| 5,062,642 | 11/1991 | Berry et al. | 272/142 X |
| 5,109,546 | 5/1992 | Dicker | 482/121 X |

FOREIGN PATENT DOCUMENTS

| | | | |
|---|---|---|---|
| 613009 | 1/1961 | Canada | 128/80 G |
| 451516 | 8/1936 | United Kingdom | 272/137 |

*Primary Examiner*—Richard J. Apley
*Assistant Examiner*—Karen A. Jalbert
*Attorney, Agent, or Firm*—Workman, Nydegger & Jensen

[57] ABSTRACT

An apparatus for augmenting exercise of body muscle(s) comprising one or more articles of close-fitting wearing apparel employing one or more removable elongate resistance members, loosely enclosed in passageways along a portion of the length of the apparel, which resistance members releasably anchored at one end to a fixed-in-place member such as a belt or a shoulder harness and attached at the distal end to the extremity of an arm or leg, the apparatus being devised so as to increase the energy required by a user to flex his arms or legs over the energy level necessary without the resistance of the elongate resistance members.

41 Claims, 7 Drawing Sheets

DEVICE TO AUGMENT EXERCISE

BACKGROUND

1. The Field of the Invention

This invention is directed to an exercise device designed to augment the exercise of body muscles without attaching weights or weighted objects to the user.

2. The Background Art

Exercise suits having built-in means for increasing the effort required of a user to run, flex his legs, flex his arms, or otherwise exercise have been developed in recent years. Such suits are an alternative to attaching weights or weighted objects to the user because they include tension straps which are stretched as the user exercises. Thus, the amount or degree of force required of the user is increased without requiring the user to carry additional weight.

Typically, such suits consist of a unitary full-length garment having a pant portion and a shirt or torso portion. Tension straps are permanently affixed in liners running the length or width of the body portion to be affected. For example, in the pant portion of such a suit, the tension straps run from a sock or boot about the user's foot to the waist region of the suit. Thus, as the user flexes and relaxes his legs, the tension straps work either with or against the user's muscles, as desired.

In some suits, similar tension straps are placed in the sleeve portions of the suit such that flexing and relaxing of the arms alternately stretches and relaxes the straps, as desired. In both cases, the tension strap is permanently attached to at least the waist region and the other end is permanently attached to a part of the suit near the foot or hand of the user such as the leg of the suit, stirrup, boot, sock, or glove.

In some suits, the attached tension straps are adjustable at some point intermediate to the length of the tension strap.

A serious disadvantage of these presently available exercise suits is the fact that the tension straps are permanently affixed to the suits. There are times when it would be desirable to replace a strap, such as when a strap is damaged through use or cleaning or when a strap having a different stress/strain ratio is desired. Ready replacement of a strap in an existing suit is difficult if, indeed, possible at all, by the user.

Another disadvantage is the fact that the pants portion and the shirt portion are of unitary construction requiring the use of the entire suit during use. This does not accommodate the user who needs or wishes to exercise only a discrete portion of the body. No such option is available with presently available suits. Furthermore, putting on such a suit is more difficult than putting on a shirt and pants separately. This might be important for handicapped people, senior citizens, persons undergoing physical therapy or rehabilitation.

A still further disadvantage is the fact that the tension straps cannot readily be removed by the user without compromising the integrity of the suit. This complicates cleaning of the suit or any desired use of the suit without the tension straps. Furthermore, there are times when a user may desire to eliminate the straps or at least to make adjustments such that continued exercise or activity does not place any extra requirements on his exertion efforts. With the existing suits, this is not possible absent the continual wearing of the entire suit with attached tension straps, gloves, boots, and the like.

A still further disadvantage is that existing suits do not effectively bias the tension strap against the body of the user with the result that the straps do not hug the body closely. This serves to at least partially affect the desired or consistent tension of the straps.

BRIEF SUMMARY AND OBJECTS OF THE INVENTION

In view of the presently available devices, it is a primary object of the present invention to provide a non-weight device for augmenting exercise comprising resistance members wherein each part of the device may be separately and independently directed to a discrete muscle group and may be separately and independently removable, replaceable, and/or interchangeable.

It is another object of the invention to provide a device for augmenting exercise wherein at least one embodiment has means to bias the resistance members against or toward the body to optimally complement muscle exercise.

It is another object of the invention to provide an exercise suit wherein various configurations such as pants, a shirt or sleeve are wholly separate and independent units such that a user may employ them either alone or in a combination, as desired.

It is another object of the invention to provide a device for augmenting exercise wherein the resistance member may be positioned at various locations relative to discrete muscles or muscle groups so as to augment the exercising of such muscles or muscle groups, as desired.

The present invention comprises, in one embodiment, a close-fitting apparatus or garment preferably fashioned from a stretch-type material such as lycra or spandex, and in another embodiment a loose-fitting apparatus or garment. One configuration may be a pant-like garment. Another configuration may be a sleeve-like apparatus. In any event, the resistance members are removably independent of, but work in conjunction with, the garment.

The present invention comprises means for biasing resistance members toward or against the body so that the tension of the resistance members is substantially consistent.

One embodiment, the pant-like garment, comprises one or more elongate passageways affixed to the garment extending substantially the length of the garment, and adapted to removably receive an elongate resistance member having a first end and a second end. At each end of the passageway there is an exit opening providing an interface between the passageway and the outside of the pant-like garment, the openings being adapted for passage therethrough of the elongate resistance member.

The passageway may be positioned in any one of a variety of positions along the body, or there may even be a plurality of passageways positioned in various positions for optional selection by the user. For instance, the passageway may be positioned so as to run along the back of the leg of the user. Alternatively, it may be positioned so as to run along the front of the leg of the user. As still another alternative, the passageway may be so devised as to run along the back of the leg over a portion of the length of the garment and along the front of the leg over another portion of the length of the garment. Additionally, it is contemplated that the passageways could, if desired, be placed upon either side of the leg over any desired portion of the length of the garment.

The present invention further comprises means for anchoring the ends of the resistance member. The anchoring means may comprise a belt-like apparatus. The belt-like apparatus encircles the waist region of a user separate and independent of the pant-like garment portion, and serves to anchor the first end of the resistance member. The belt-like apparatus comprises means for releasably attaching the first end of each elongate resistance member to the belt-like apparatus. The means for releasably attaching the first end comprises a clip or, preferably, a cinch-buckle. The specific means will, of course, be dependent upon the specific type of elongate resistance member employed. The belt-like apparatus may further comprises a cinch-buckle for tightening about the waist region of the user.

Each elongate resistance member comprises any one of a variety of resistance devices such as surgical tubing, an elastic cord, an elastic web or strap, or any equivalent. Surgical tubing is preferred. The resistance members are freely disposed in the passageways.

The anchoring means further comprises one or more limb cuffs, such as a calf or ankle cuff devised to reasonably encircle the lower calf or ankle. The limb cuff is adapted to be removably affixed to the leg of a user separate from the pant-like garment at or near the lower calf or the ankle.

The limb cuff comprises a member to encircle the lower calf or ankle adapted with a means for joining and/or tightening the member around the calf or ankle of the user's leg. Preferably the joining means comprises a cinch-buckle which permits the user to adjust the diameter of the limb cuff to suit the user's particular size. The limb cuff also comprises means for releasably securing the second end of the resistance member to the limb cuff.

Furthermore, the present invention preferably comprises means for increasing or decreasing the degree of resistance of the resistance member. Any conventional means to adjust the length of the elongate member would satisfactorily function. Preferably, the cinch-buckle previously discussed is used. It comprises a means for adjusting the length or resistance of the resistance member. In any event, the tension adjustment means permits the user to lengthen or shorten the elongate resistance member, and thus decrease or increase the resistance to a desired degree. It follows that as the resistance is increased, the force required by the user to exercise is increased since the force necessary to stretch the elongate resistance member is increased.

In some embodiments, the resistance member is removably disposed in the passageway so that, if desired, the anchoring means may be disengaged and the entire resistance member and/or anchoring means removed from the user without requiring the user to remove the pant-like garment. In another embodiment, the resistance member is held against the outside of the pant-like garment. The resistance member may be similarly removably disposed with respect to the other embodiments discussed below.

The present invention also contemplates the belt-like apparatus further comprising means for releasably attaching one or more additional elongate resistance members having first and second ends. The additional elongate resistance members are releasably attached to the belt-like apparatus at the first end. The second end is attached to a handle or grip. In use, the additional elongate resistance members extend substantially laterally from the belt-like apparatus to the handle or grip as clasped by the user. The additional elongate resistance member(s) is adapted with means to lengthen or shorten the resistance member. This contemplates an additional waist-attached arm exerciser.

The present invention may also be configured in a sleeve-like apparatus comprising a sleeve and other items. The sleeve-like apparatus comprises one or more elongate passageways affixed to the sleeve. The passageways extend substantially the length of the sleeve-like apparatus, and are adapted to removably receive an elongate resistance member, as discussed above. At each end of the passageway, there is an exit opening in the sleeve communicating between the passageway and the outside of the sleeve. The opening is adapted for the passage therethrough of the above-noted elongate resistance member. As discussed above in connection with the pant-like garment, the passageway(s) may be positioned on any side or combination of sides of the sleeve.

The sleeve-like apparatus further comprises a shoulder harness which, like the belt-like apparatus discussed above, anchors a first end of the elongate resistance member. The shoulder harness comprises a pair of shoulder assemblies adapted to encircle the upper parts of the arms adjacent the shoulders. The shoulder assemblies are joined across the user's back by a band, preferably flexible, attached to each shoulder assembly. The shoulder harness further comprises an adjustable strap across the chest of the user and a cinch-buckle for adjustment and tightening of the chest strap.

The shoulder harness further comprises means for removably attaching the first end of the elongate resistance member thereto such as a clip or, preferably, a cinch-buckle. The specific attaching means will, of course, be dependent upon the specific type of elongate resistance member employed. Preferably, a cinch-buckle is employed having itself means for adjusting the resistance of the resistance member.

As before, the elongate resistance member may comprise of any one of a variety of items such as surgical tubing, an elastic cord, or an elastic web or strap. Surgical tubing is preferred.

The sleeve-like apparatus further comprises a wrist cuff. The wrist cuff is devised to removably encircle the forearm or wrist of a user. The wrist cuff is also configured with means for releasably attaching the second end of the elongate resistance member. The wrist cuff also incorporates means for tightening the wrist cuff around the wrist or forearm, all in a manner similar to that of the limb cuff described above.

A sleeve-like apparatus employing a single sleeve may be employed, which can be used interchangeably on either arm. Alternatively, the sleeve-like apparatus may be configured to comprise two sleeves for concurrent use on both arms. In either event, the sleeve-like apparatus may be incorporated into a shirt-like garment.

BRIEF DESCRIPTION OF THE DRAWINGS

In order that the manner in which the above-recited advantages and other advantages as well as the objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which:

FIG. 5 (*a*) is a partial view showing a user wearing a sleeve-like apparatus in another embodiment of the invention.

FIG. 5(*b*) is a partial view showing a user wearing a sleeve-like apparatus in another embodiment of the invention.

DETAILED DESCRIPTION OF THE PREFERRED EMBODIMENTS

The present invention comprises one or more resistance members and means for releasably anchoring the resistance member(s) separate and independent of any other apparel such that the resistance may be removed from the user independent of any other apparel. The invention further comprises means for biasing the resistance member(s) against or toward the user's body.

The invention may comprise either a pant-like configuration, a sleeve-like apparatus comprising one or two sleeves, a sleeve-like apparatus incorporating a shirt, or a combination, each having means incorporated therein for increasing the exertion required of a user when exercising, e.g., running, rowing, operating a tread mill, or other activity which entails the flexing and relaxing of the arms and/or leg muscles. The inventions may also comprise a waist-attached arm exerciser.

Figure 1:
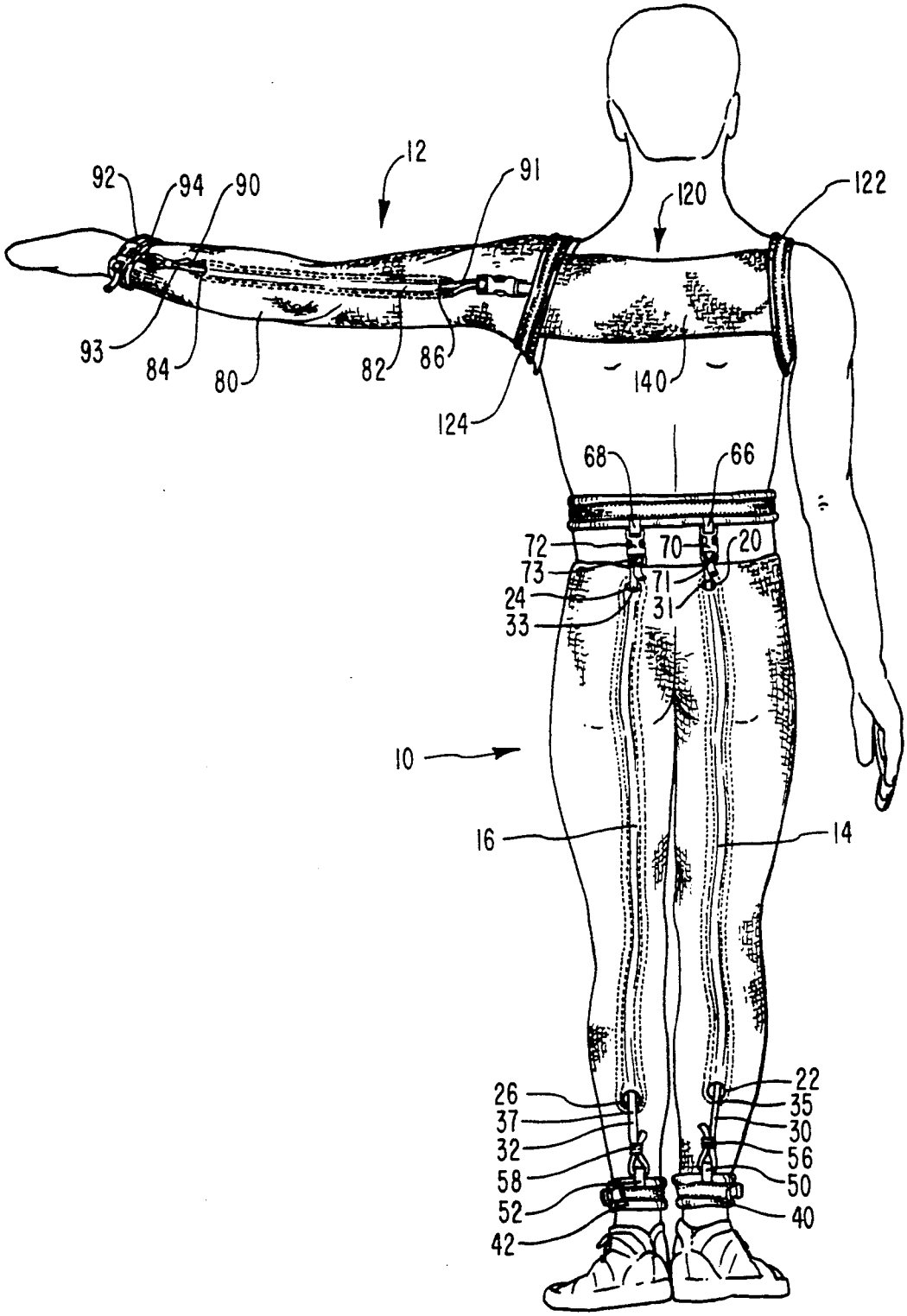
FIG. 1 is a rear-facing view showing a user wearing a close-fitting, pant-like garment and a sleeve-like apparatus embodying the present invention showing one embodiment of the invention.

One embodiment of the invention in FIG. 1 shows pant-like garment 10 and sleeve-like apparatus 12. Garment 10 in one embodiment preferably comprises a stretch material such as lycra or spandex and is fashioned so as to be a close-fitting, body-hugging design. Garment 10 incorporates a pair of passageways 14 and 16, shown in phantom. While not necessary for the practice of the invention, passageways 14 and 16 are preferably fashioned on the inside surface of garment 10. Passageways 14 and 16 run generally from a point near the calf of the leg to a point near the waist of the user. In the embodiment in FIG. 1, passageways 14 and 16 are positioned so as to be substantially in the back of the leg sections. It is not necessary for the practice of this invention that both passageways 14 and 16 be used. It is contemplated that the passageway may, if desired, be associated with just one leg or limb of the user.

An opening 20 is provided near one end of passageway 14 and a second opening 22 is provided near the other end of passageway 14. Corresponding openings 24 and 26 are provided for passageway 16. Openings 20, 22, 24 and 26 are fashioned so as to provide communication between the passageways and the exterior of pant-like garment 10, all as shown. Further, openings 20, 22, 24 and 26 are fashioned so as to permit removable elongate resistance members, to be described hereafter, to pass therethrough and be disposed into the passageways. Normally openings 20, 22, 24, and 26 will be simply holes, although they may be slots, or any other suitable configuration.

A removable elongate resistance member 30 is threaded through opening 20, passageway 14, and opening 22, and a similar removable elongate resistance member 32 is threaded through opening 24, passageway 16, and opening 26. Elongate resistance members 30 and 32 may be fashioned from elastic webbing or cord or tubing. Surgical tubing is presently preferred. Elongate members 30 and 32 have first ends 31 and 33 respectively and second ends 35 and 37 respectively.

Figure 2:
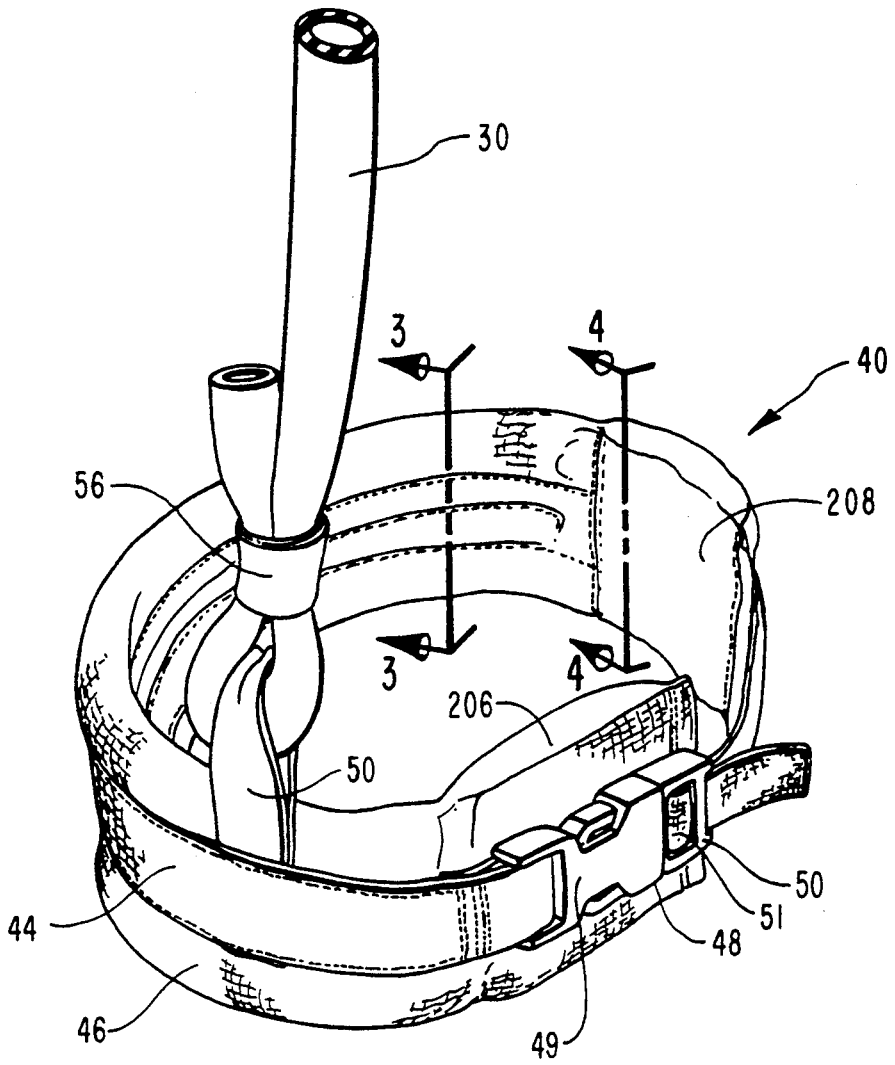
FIG. 2 is an enlarged perspective view showing a limb cuff with a cinch-buckle.

An independently separable limb cuff 40 is provided for the right leg, and a similar separable limb cuff 42 is provided for the left leg. Limb cuffs 40 and 42 encircle the calves or lower calves of the legs. Limb cuffs 40 and 42 may be simple straps with normal cinch-tightening means. Preferably, however, they comprise padded bands fashioned by sewing a webbed strap 44 to a padded leg band 46, as shown in FIG. 2. One end of webbed strap 44 is attached to the socket portion 49 of a standard cinch-buckle 48. The other end of webbed strap 44 is attached to the plug portion 50 of the cinch-buckle 48. Additionally, plug portion 50 incorporates means 51 for cinch-type fastening so as to provide for adjusting the diameter of the leg band, as shown in FIG. 2. These cinch-buckles, being standard well-known items, are not described further herein. Of course, other type fasteners may be used.

Figure 3:
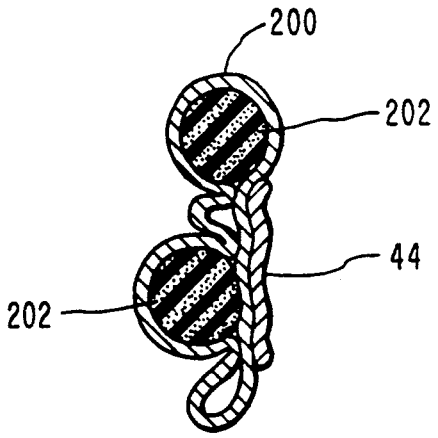
FIG. 3 is a cross sectional view taken along the line 3—3 of FIG. 2.
Figure 4:
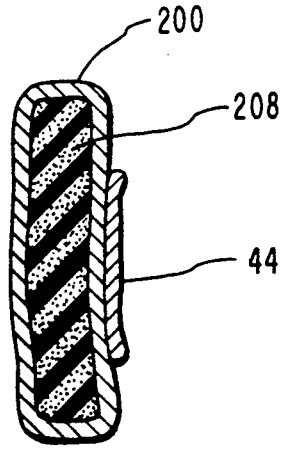
FIG. 4 is a cross sectional view taken along the line 4—4 of FIG. 2.

Padded band 46 is shown in FIGS. 2, 3, and 4. Padded band 46 comprises an elongate strip of fabric 200 encasing two or more lengths of resilient padding 202, such as foam rubber, by sewing, riveting, or any conventional means f or so encasing padding 202. Resilient pads 206 and 208 are also positioned at the ends of the padding 202. FIG. 4 is illustrative of resilient pad 208, as well as resilient pad 206.

Limb cuffs 40 and 42 have loops 50 and 52 attached thereto respectively. Loops 50 and 52 are devised so as to removably accept, by threading therethrough, second ends 35 and 37 of elongate resistance members 30 and 32. Ends 35 and 37 are then doubled back and secured to themselves by means 56 and 58 for binding them together. Binding means 56 and 58 may be any conventional binding means which permits, when desired, members 30 and 32 to be replaced or changed. Binding means 56 and 58 is preferably plastic adhesive tape.

Figure 5:
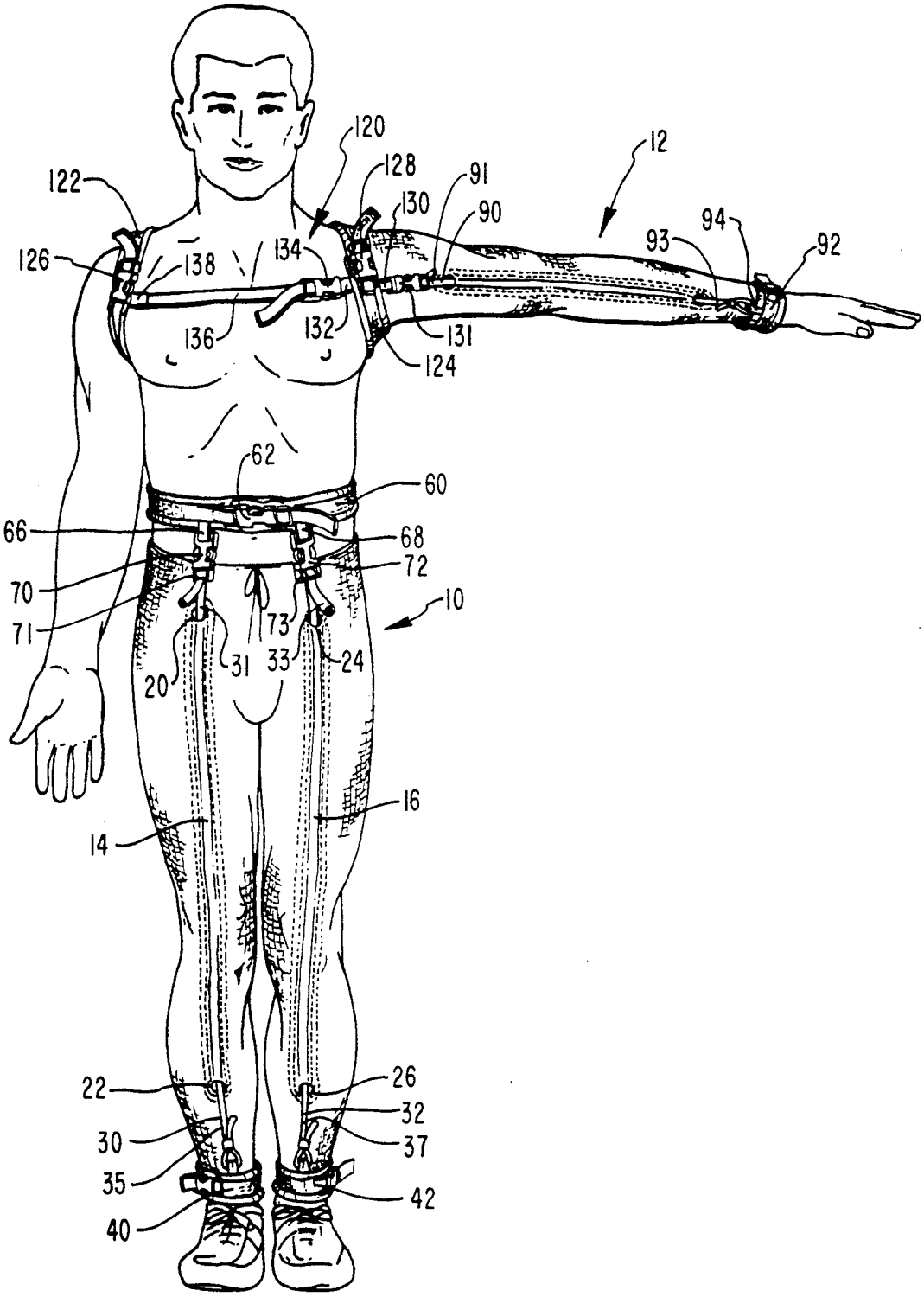
FIG. 5 is a front-facing view showing a user wearing a close-fitting pant-like garment and a sleeve-like apparatus embodying the present invention showing another embodiment.
Figure 5A:
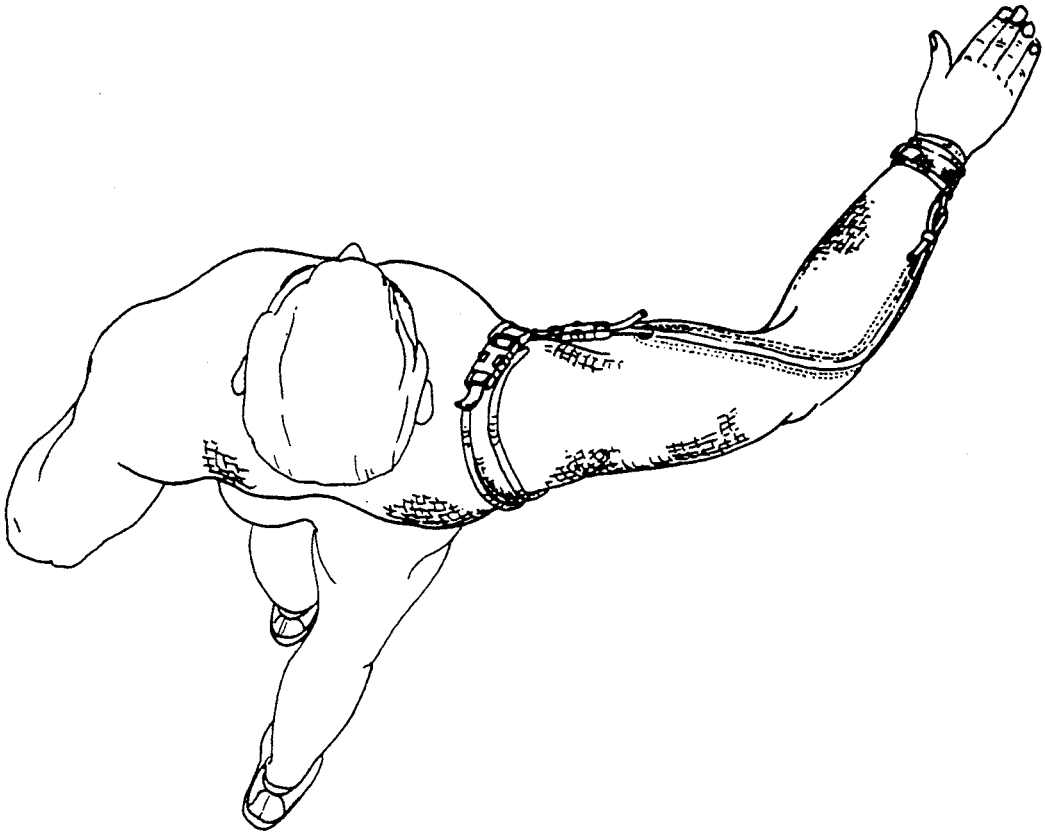
Figure 5B:
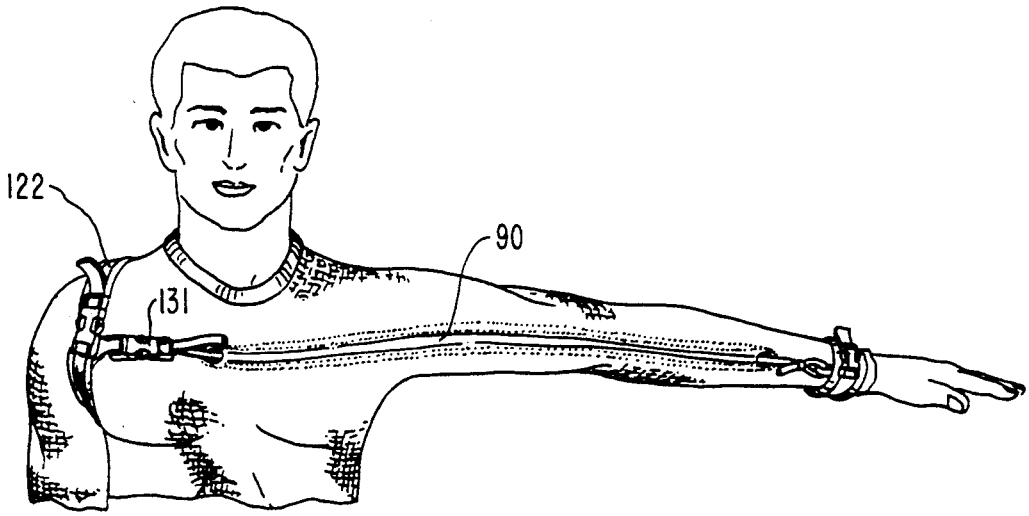

A removable padded belt-like apparatus 60, devised to encircle the torso independent of any apparel, is provided having a releasable buckle 62 (See FIG. 5). Belt 60 is preferably fashioned in a manner previously described for limb cuffs 40 and 42. Loops 66 and 68 are strategically positioned and attached to belt 60. Loops 66 and 68 serve to accept and secure means 70 and 72 for releasably anchoring ends 31 and 33 of members 30 and 32. Anchors 70 and 72 are preferably cinch-buckles, similar to cinch-buckle 48 described previously.

Also provided are tension-adjusting members 71 and 73 which may be separate items but are preferably integral parts of anchors 70 and 72. As shown fasteners 70 and 72 are preferably positioned near ends 31 and 33 of the resistance 24 members 30 and 32, but alternatively similar anchors could be positioned near ends 35 and 37 near limb cuffs 40 and 42.

Another embodiment of the pant-like garment 10 is shown in FIG. 5. This embodiment is similar to that shown in FIG. 1 except that passageways 14 and 16, and thus corresponding resistance members, are positioned so as to run the length of the front of the legs rather than the rear of the legs of the user. Corresponding elements for FIG. 5 are like numbered as the corresponding elements of FIG. 1.

Figure 6:
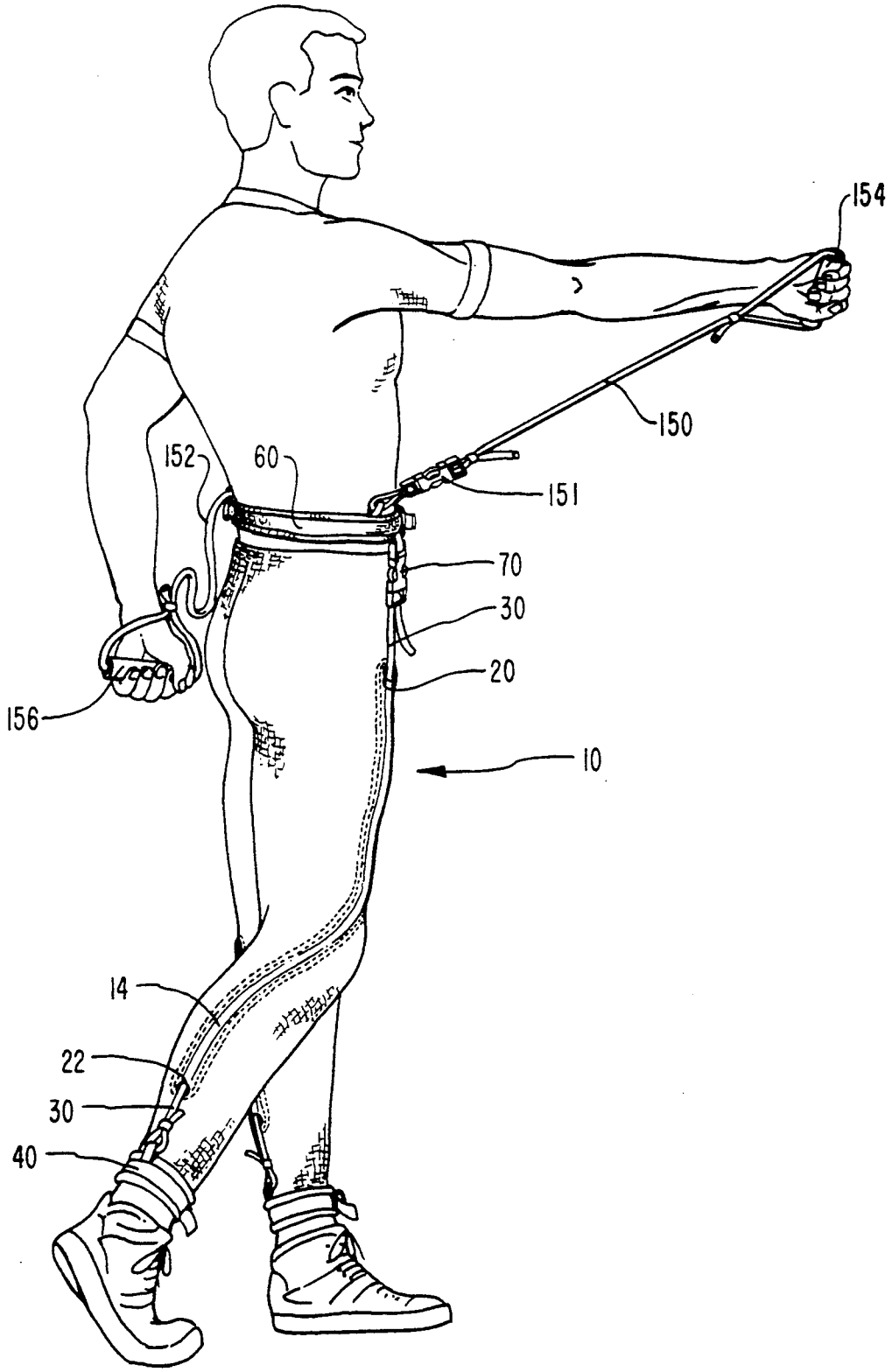
FIG. 6 is a side-facing view showing a user wearing a pant-like garment in another embodiment of the invention and employing an arm exerciser.

A third embodiment of the pant-like garment is shown in FIG. 6. In this embodiment passageways 14 and 16, and thus the elongate resistance members, are positioned so as to run along the backs of the legs over a portion of the length of the user's legs then crossing over to the fronts of the legs over another portion of their course. As shown in FIG. 6, passageway 14 is positioned along the back of the leg over the lower portion of the leg and along the front of the leg over the upper portion of the leg. This could be reversed or adapted to the individual user as desired or required to augment exercise of any discrete muscle or muscle group.

As shown in FIG. 1, sleeve-like apparatus 12 is devised to be removable and extends from approximately the wrist to the shoulder. An elongate passageway 82, shown in phantom in FIG. 1, is fashioned along the length of the backside of sleeve 80. In this embodiment, passageway 82 is positioned so as to be substantially adjacent to the outwardly crooking portion of the arm. FIG. 5 shows the passageway 82 positioned along the front side of sleeve 80, and thus substantially adjacent to the inwardly crooking portion of the arm. FIG. 5(*a*) shows an embodiment wherein the passageway 82 switches from the front side to the back side.

An opening 84 is positioned near the distal end of passageway 82 and a second opening 86 is positioned near the proximal end of passageway 82. Openings 84 and 86 are fashioned so as to provide communication between the passageways and exterior of sleeve 80, all as shown. Further, openings 84 and 86 are fashioned so as to permit removable elongate resistance member 90 to pass therethrough and be disposed in passageway 82. Normally openings 84 and 86 will be simply holes, although they may be slots, or any other suitable configuration.

A removable elongate resistance member 90 occupies passageway 82 and is threaded through and exits same at openings 84 and 86. Resistance member 90 may be fashioned from elastic webbing or cord or tubing. Surgical tubing is presently preferred. Resistance member 90 has a first end 91 and a second end 93. (See FIGS. 1 and 5)

An independently separable wrist cuff 92 is provided, to encircle the wrist as shown. Wrist cuff 92 is similar in design, construction and function to limb cuffs 40 and 42 previously discussed. Wrist cuff 92 has a loop 94 attached thereto, to which the second end 93 of resistance member 90 is attached. Second end 93 is attached to loop 94 as end 35 attaches to loop 50.

A removable shoulder harness 120 is also provided, a rear view being shown in FIG. 1 and a front view in FIG. 5. As shown, two adjustable shoulder assemblies 122 and 124 are incorporated, having corresponding cinch-buckles 126 and 128, and constructed similarly to limb cuffs 40 and 42 and wrist cuff 92. As shown in FIG. 5, loop 130 is attached to shoulder assembly 124 to which cinch buckle 131 is attached. Elongate resistance member 90 is then adjustably attached to cinch-buckle 131. Shoulder assembly 124 also has a loop 132 attached thereto which secures cinch-buckle 134. A harness strap 136 is in turn adjustably secured to buckle 134 at one end as shown. The other end of strap 136 is attached to shoulder assembly 122 at 138. Additionally, as shown in FIG. 1, shoulder assemblies 122 and 128 are interconnected by a band 140 preferably flexible, which is positioned against the back of the user when in use. Band 140 is fashioned from a stretchable material such as lycra. Thus, shoulder harness 120 serves to anchor the first end of resistance member 90.

Another embodiment of the sleeve-like apparatus is shown in FIG. 5(*b*). In this embodiment, elongate resistance member 90 is removably attached to shoulder assembly 122. Thus, as shown, cinch-buckle 131 fastens to shoulder assembly 122. In other words, elongate resistance member 90 crosses the chest of the user.

As shown in FIG. 1, sleeve 80 is shown placed on the left arm of the user. The entire sleeve-like apparatus 12 is designed to be able to be alternatively placed on the right arm if desired, or there could be a sleeve-like apparatus 12 constructed for simultaneous use on both arms. Although sleeve-like apparatus 12 is shown separately, it could also be fashioned as a part of a shirt, which could in turn be separate from, or integral with, the pant-like garment 10. However, it is currently preferred to have the sleeve-like apparatus 12, pant-like garment 10, belt-like apparatus 60, limb cuffs 40 and 42, and wrist cuff 92 all separate, independent, removable and interchangeable units providing a system that may be custom designed or custom fit to the need of the individual user. This also offers the advantage that is the separate units may be removed, repaired, replaced, adjusted, cleaned, or used entirely independent of the other units.

The benefit of having all units separate and independent is readily appreciated when the circumstances of the individual user are assessed. If physical therapy is needed for only an arm, then a sleeve-like apparatus only need be employed. If physical therapy is needed for only a right thigh or knee, pant-like garment 10 may conveniently be utilized incorporating only the right leg resistance member without encumbering the user with left leg apparatus. On the other hand, if a jogger wishes to augment the exercise of both legs, he may do so by utilizing both leg-resistance members. At the appropriate time, or as desired, the user may immediately detach and remove the resistance members for continued, unaugmented exercise.

Figure 7:
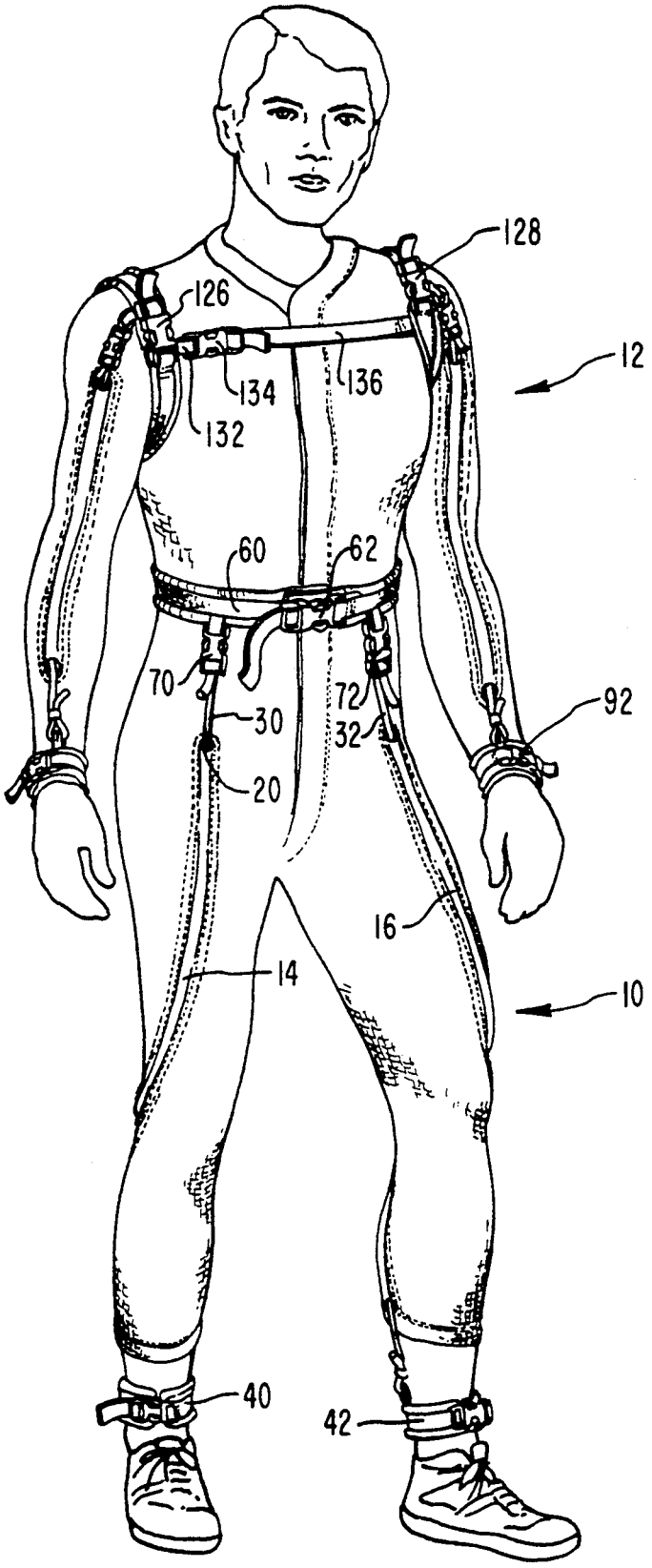
FIG. 7 is a perspective view showing a user wearing a combination of a pant-like garment with a shirt-like garment comprising two sleeves.

FIG. 7 shows a view wherein a pant-like garment, a shirt, and a sleeve-like apparatus incorporating two sleeves are combined as a suit unit.

Figure 8:
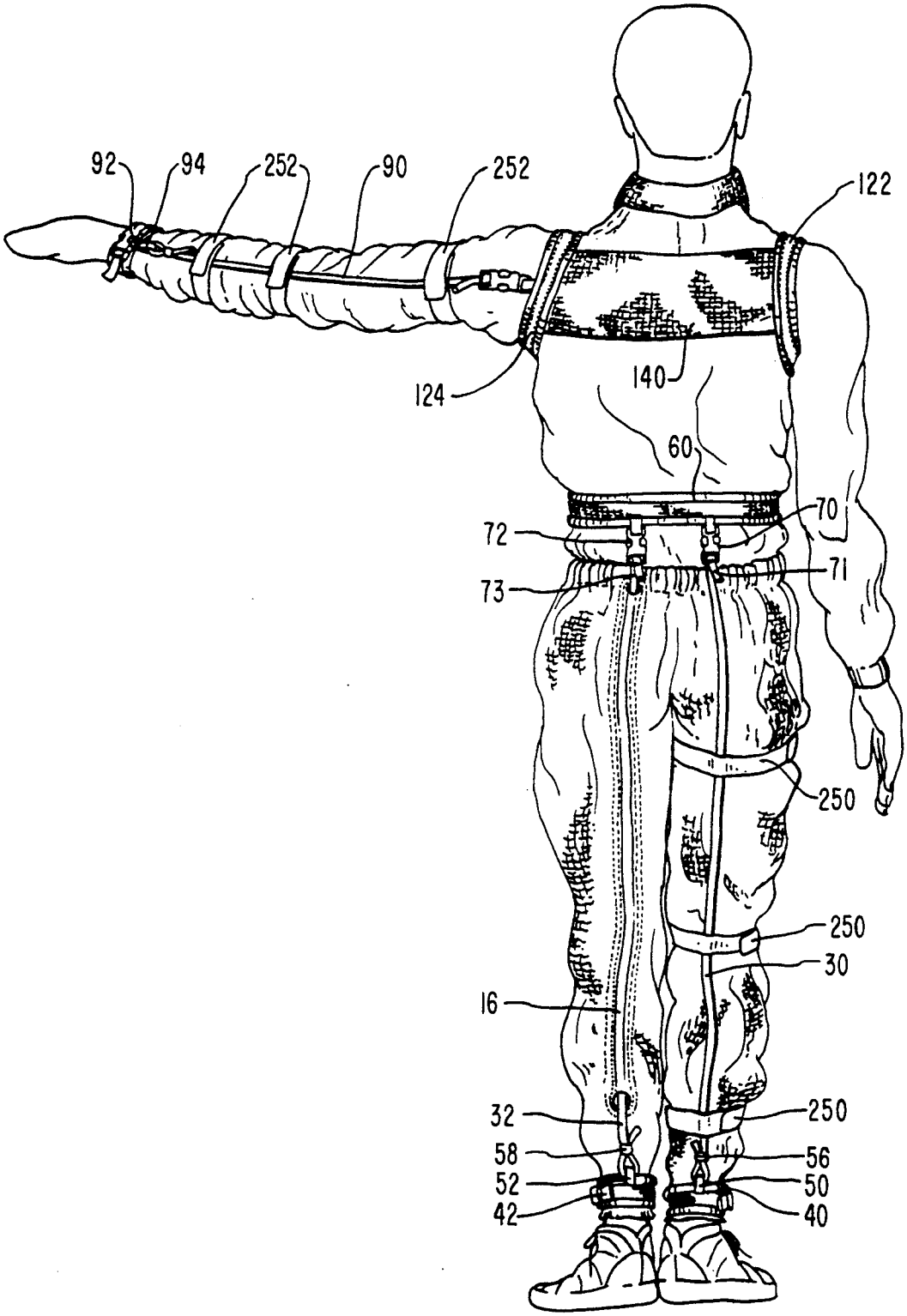
FIG. 8 is a rear-facing view corresponding to FIG. 1 except showing various embodiments of a loose-fitting pant-like garment and sleeve-like apparatus.

FIG. 8 shows a still further embodiment of the invention wherein loose-fitting articles of wearing apparel are employed rather than close-fitting. In this embodiment, the passageways may or may not be employed, as desired. Thus, for example. a passageway 14 is shown for the right leg, but none for the left leg.

Additionally, one or more limb bands such as velcro strips may be employed encircling an arm or a leg, to give the effect of a close-fitting garment. Velcro strips 250 and 252 are chosen by way of example in FIG. 8.

A still further embodiment of the invention is shown in FIG. 6. This embodiment comprises belt 60, fashioned as described previously, a pair of elongate resistance members, 150 and 152, and a pair of hand-holds, 154 and 156. Elongate resistance members 150 and 152 have their distal ends looped so as to form respective y-shaped loops which are in turn attached to hand-holds 154 and 156, as shown. The proximal ends of resistance members 150 and 152 are attached to cinch-buckles, such as 151, which are in turn attached to loops fastened to belt 60, all as shown and previously described for other embodiments. Then as the user flexes and relaxes his arm or arms, such as could be done while exercising, resistance members 150 and 152 are alternately stretched and released. Hand-holds 154 and 156 comprise any suitable construction compatible with receiving distal ends of resistance members 150 and 152.

In each embodiment, except the waist-attached arm exerciser of FIG. 6, the relevant resistance member is biased against or toward the body of the user. This offers protection to the user and a more consistent tension in the resistance member.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for augmenting the exercise of body muscle(s) comprising:

one or more closing-fitting articles of wearing apparel configured to encompass one or more limbs of the user, the article(s) comprising one or more elongate passageways along a portion of the length of the limbs, one or more releasably anchored resistance members, the passageway(s) configured to removably receive the releasably anchored resistance member and to bias the resistance member against or toward the body of the user when in use, the resistance member being extendable in a longitudinal direction, wherein the means for anchoring the first end and second end of the resistance member are releasably attached to the body of the user independent of wearing apparel.

2. An apparatus for augmenting the exercise of body muscle(s) comprising:

one or more close-fitting articles of wearing apparel configured to encompass one or more limbs of the user, said article(s) comprising:

one or more an elongate passageways traversing a length of the body of the user, one or more elongate resistance members having a first end and a second end, the resistance member occupying the elongate passageway and being extendable in the longitudinal direction, and means for releasably anchoring the first end and the second end of the resistance member, wherein said anchoring means is releasably attached to the body of the user independent of wearing apparel.

3. An apparatus as defined in claim 2 wherein the anchoring means for the first end of the resistance member comprises a belt-like apparatus, and wherein the anchor means for the second end of the resistance member comprises a limb cuff.

4. An apparatus as defined in claim 2 wherein the anchoring means for the first end of the resistance member comprises a shoulder harness, and wherein the anchor means for the second end of the resistance member comprises a wrist cuff.

5. An apparatus for augmenting the exercise of body muscle(s), comprising:

one or more close-fitting, articles of wearing apparel configured to encompass one or more limbs of a user, said article(s) comprising one or more elongate passageways along a portion of the length of the limb, configured to removably receive an elongate resistance member being extendable in the longitudinal direction, and to bias the resistance member against or toward the body of a user when in use;

one or more elongate resistance members having a first end and a second end;

means for releasably anchoring the first end and the second end of the resistance member, wherein said anchoring means is releasably attached to the body of the user independent of wearing apparel, and wherein the anchor means for the first end encircles the torso of the user's body and wherein the anchor means for the second end encircles the limb at a location distal to the torso;

means for removably attaching and detaching said anchor means.

6. An apparatus as defined in claim 5 further comprising means for adjusting the resistance of the elongate resistance member.

7. An apparatus as defined in claim 6 wherein the means for adjusting the resistance of the elongate resistance member comprises a tension adjustment member, positioned intermediate the ends of said elongate resistance member, which tension adjustment member is configured to selectively tension the elongate resistance member as desired.

8. An apparatus as defined in claim 7 wherein the tension adjustment member is fashioned as an integral part of a releasable cinch-buckle.

9. An apparatus as defined in claim 5 wherein the elongate resistance member is flexible tubing.

10. An apparatus as defined in claim 5 wherein the elongate resistance member is an elastic cord.

11. An apparatus as defined in claim 5 wherein the elongate resistance member is an elastic strap.

12. An apparatus as defined in claim 5 wherein the article of wearing apparel is a pant-like garment.

13. An apparatus as defined in claim 12 wherein the article of wearing apparel is fashioned from stretch-type material.

14. An apparatus as defined in claim 13 wherein the material is lycra.

15. An apparatus as defined in claim 13 wherein the material is spandex.

16. An apparatus as defined in claim 12 wherein at least one passageway is configured and positioned so as to run along the back of the leg of a user.

17. An apparatus as defined in claim 12 wherein at least one passageway is configured and positioned so as to run along the front of the leg of a user.

18. An apparatus as defined in claim 12 wherein at least one passageway is configured and positioned so as to have a first portion of the passageway run along the back of the leg of a user and a second portion run along the front of the leg of a user.

19. An apparatus as defined in claim 12 wherein the anchor means for the first end of the resistance member comprises a belt-like apparatus.

20. An apparatus as defined in claim 19 wherein the belt comprises an elongate padded band having an, elongate strap affixed along the length thereto, with corresponding cinch-buckle members attached to the ends of said elongate strap.

21. An apparatus as defined in claim 20, wherein the means for removably attaching the first end of the resistance member to the belt-like apparatus comprises a cinch-buckle attached to the belt-like apparatus.

22. An apparatus as defined in claim 12 wherein the anchor means for the second end of the resistance member is configured to encircle the limb of the user at a location distal to the torso in a limb cuff.

23. An apparatus as defined in claim 22 wherein the limb cuff comprises a padded band configured to releasably encircle the user's lower calf or ankle.

24. An apparatus as defined in claim 23 wherein the second end of the resistance member is removably attached to the limb cuff.

25. An apparatus as defined in claim 5 wherein the article of wearing apparel is a sleeve-like apparatus comprising at least a sleeve.

26. An apparatus as defined in claim 25, wherein the sleeve is fashioned from stretch-type material.

27. An apparatus as defined in claim 26 wherein the material is lycra.

28. An apparatus as defined in claim 26 wherein the material is spandex.

29. An apparatus as defined in claim 25 wherein at least one passageway is configured and positioned so as to run along a portion of the arm of a user.

30. An apparatus as defined in claim 25 wherein at least one passageway is configured and positioned so as to traverse a portion of the arm on one side of the arm and then to traverse a second portion of the arm on another side of the arm.

31. An apparatus as defined in claim 25 wherein the means for anchoring the first end of the resistance member comprises a shoulder harness.

32. An apparatus as defined in claim 31, wherein the shoulder harness comprises a pair of adjustable shoulder assemblies configured so to encircle respective arms adjacent the shoulders of the user and having cinch-buckles adapted to adjust the diameter of said shoulder assemblies, a harness strap having two ends configured so as to cross the chest of a user and having a cinch-buckle positioned intermediate the ends thereof ; the shoulder assemblies further comprising cinch-buckles to function as means f or releasably anchoring the first end of the resistance members; and a flexible band configured so as to traverse the back of the user and be affixed at its ends to the shoulder assemblies.

33. An apparatus as defined in claim 25 wherein the means for anchoring the second end of the resistance member at a position distal to the torso comprises a wrist cuff.

34. An apparatus as defined in claim 5 wherein the one or more articles of wearing apparel comprises a sleeve-like apparatus comprising two sleeves, one for each arm.

35. An apparatus as defined in claim 5 wherein the one or more articles of wearing apparel comprises a pant-like garment and a sleeve-like apparatus comprising at least one sleeve, the pant-like garment and the sleeve-like apparatus being separate from each other.

36. An apparatus as defined in claim 5 wherein the one or more articles of wearing apparel comprises a sleeve-like apparatus comprising at least one sleeve and a shirt which are integral with each other.

37. An apparatus as defined in claim 5 wherein the one or more articles of wearing apparel comprises a sleeve-like apparatus comprising at least one sleeve and a shirt which are integral with each other and a separate pant-like garment.

38. An apparatus as defined in claim 5 wherein the one or more articles of wearing apparel comprises a sleeve-like apparatus comprising at least one sleeve, a shirt, and a pant-like garment which are integral with each other.

39. An apparatus for augmenting the exercise of body muscle(s), comprising:

one or more close-fitting, articles of wearing configured to encompass one or more limbs of the user, the article(s) comprising one or more elongate passageways along a portion of the length of the limb, one or more releasably anchored resistance members, the passageway(s) configured to removably receive the releasably anchored resistance member, the releasable member being extendable in the longitudinal direction, the elongate member having a first end and a second end;

means for releasably anchoring the first end and the second end of the resistance member, wherein said anchoring means is releasably attached to the body of the user independent of wearing apparel, and wherein the anchor means for the first end encircles the torso of the user's body and wherein the anchor means for the second end encircles the limb at a location distal to the torso; and means for removably attaching and detaching said anchor means.

40. An apparatus as defined in claim 39 comprising further one or more limb bands configured to encircle snugly the limb of a user, over the article of wearing apparel.

41. An apparatus as defined in claim 40 wherein the limb band comprises a band of flexible material having cooperating VELCRO strips attached at respective ends.

* * * * *